US011705680B2

(12) United States Patent
Liu

(10) Patent No.: US 11,705,680 B2
(45) Date of Patent: Jul. 18, 2023

(54) WALL-MOUNTED ELECTRICAL-CONNECTOR-ENGAGING ASSEMBLY WITH QUICK INSTALLATION FEATURES

(71) Applicant: Drew Syingshun Liu, Racine, WI (US)

(72) Inventor: Drew Syingshun Liu, Racine, WI (US)

( * ) Notice: Subject to any disclaimer, the term of this patent is extended or adjusted under 35 U.S.C. 154(b) by 50 days.

(21) Appl. No.: 17/331,055

(22) Filed: May 26, 2021

(65) Prior Publication Data

US 2021/0376538 A1 Dec. 2, 2021

Related U.S. Application Data

(60) Provisional application No. 63/030,571, filed on May 27, 2020.

(51) Int. Cl.

| | |
|---|---|
| ***H01R 13/74*** | (2006.01) |
| ***H01R 24/76*** | (2011.01) |
| ***H01R 43/26*** | (2006.01) |

(52) U.S. Cl.

CPC ..... *H01R 13/741* (2013.01); *H01R 24/76* (2013.01); *H01R 43/26* (2013.01)

(58) Field of Classification Search

CPC ..... H01R 24/76; H01R 13/741; H01R 43/26; H01R 13/213; H01R 24/66; H01R 13/59; H01R 13/512; H01R 13/5213; H01R 13/748

See application file for complete search history.

(56) References Cited

U.S. PATENT DOCUMENTS

| | | | |
|---|---|---|---|
| 2,030,115 | A | 2/1936 | Muldoon |
| 3,270,267 | A | 8/1966 | Nolte, Jr. |
| 3,850,494 | A | 11/1974 | Glover |
| 4,310,213 | A | 1/1982 | Fetterolf et al. |
| 4,390,226 | A | 6/1983 | Hohn |
| 5,100,341 | A | 3/1992 | Czyz et al. |

(Continued)

FOREIGN PATENT DOCUMENTS

| | | | |
|---|---|---|---|
| EP | 2 357 708 | A1 | 8/2011 |
| GB | 182097 | A | 8/1923 |

OTHER PUBLICATIONS

StayOnline. Power Connectivity Products. NEMA Straight Blade Reference Chart. www.stayonline.com/reference-nema-straight-blade. 3 pages.

(Continued)

*Primary Examiner* — Jean F Duverne
(74) *Attorney, Agent, or Firm* — Jansson Munger McKinley & Kirby Ltd.

(57) ABSTRACT

A wall-mounted electrical-connector-engaging assembly for axial engagement with an electrical connector, the assembly including (a) a wall-surface adapter having front and back faces and attached to a wall over an opening in the wall and (b) a backcap. The adapter back face has a plurality of wire-connection points for installation of a corresponding plurality of wires, and the adapter front face has a plurality of slidably-engaging electrical connection points for engagement in at least an axial direction with the electrical connector. The backcap surrounds the plurality of wire-connection points and adjacent portions of the corresponding plurality of wires connected thereto, and includes a twist lock for installation on the wall-surface adapter.

10 Claims, 4 Drawing Sheets

(56) References Cited

U.S. PATENT DOCUMENTS

| | | | | |
|---|---|---|---|---|
| 5,454,731 | A | 10/1995 | Dickie | |
| 5,545,046 | A | 8/1996 | Masuda et al. | |
| 5,722,847 | A | 3/1998 | Haag | |
| 7,090,533 | B1 | 8/2006 | Houck et al. | |
| 8,506,315 | B2 * | 8/2013 | Canedo | B60L 53/305 439/372 |
| 9,634,435 | B1 * | 4/2017 | Raschilla | B60L 53/16 |
| 9,821,671 | B2 | 11/2017 | Mueller et al. | |
| 10,199,785 | B2 * | 2/2019 | Higashiura | H01R 13/652 |
| 2013/0271075 | A1 * | 10/2013 | Restrepo | B60L 53/16 320/109 |

OTHER PUBLICATIONS

Leviton. Straight Blade Connectors. www.leviton.com. 8 pages. Date: Copyright 2012-2014.

PCT International Application No. PCT/US2021/34293. International Search Report and Written Opinion, dated Sep. 14, 2021 (7 pages).

* cited by examiner

WALL-MOUNTED ELECTRICAL-CONNECTOR-ENGAGING ASSEMBLY WITH QUICK INSTALLATION FEATURES

RELATED APPLICATION

This application claims the benefit of U.S. Provisional Application Ser. No. 63/030,571, filed on May 27, 2020, the entire contents of which are incorporated herein by reference.

FIELD OF THE INVENTION

This invention is related generally to electrical connectors and, more specifically, electrical connectors for heavy-duty high-amperage uses.

BACKGROUND OF THE INVENTION

Electrical connectors of the prior art exist in many forms and are characterized by factors such as their pinout, physical construction, size, contact resistance, insulation between pins, ruggedness and resistance to vibration, resistance to entry of water or other contaminants, resistance to pressure, reliability, lifetime and ease of connecting and disconnecting. Electrical connectors of the prior art may be keyed to prevent insertion in the wrong orientation. Electrical connectors may also include various locking mechanisms to verify that they are fully inserted and unable to be accidentally withdrawn.

Electrical connectors which are heavy-duty and used for high-amperage applications are typically used in either outdoor or indoor settings and for a variety of purposes such as power-supply connections to vehicles, appliances and the like. In such applications, the electrical connector, typically on the end of a heavy-duty power cord, is connected and disconnected frequently to/from a wall-mounted electrical-connector-engaging assembly which is installed during the manufacturing of the vehicle, appliance, or the like. Common examples of such applications are recreational vehicles and trailers.

U.S. Pat. No. 9,136,640 (Liu '640), filed on Oct. 7, 2013 and titled "Heavy-duty Straight-blade Electrical Connector with Engagement-Facilitating Features," is one example of the prior art. The connector of the Liu '640 patent has a connector-body main portion including a forward portion terminating in a connecting face presenting the engagement means of the connector for axial engagement with the engagement means of the connector-engaging member. The connector also includes a connector-body cord-engagement portion for permanent trans-axial securement of the cord to the main portion and a rearward gripping portion for facilitating manual engagement and disengagement of the connector with the connector-engaging member.

In the field of electrical connectors, there is a need to improve the efficiency of the manufacturing processes of the end products in which electrical connectors are used, and the present invention is an improvement to wall-mounted electrical-connector-engaging assemblies which improves the installation efficiency of the wall-mounting and wiring-connection procedures thereof during manufacturing of vehicles, appliances, and the like.

SUMMARY OF THE INVENTION

The present invention is a wall-mounted electrical-connector-engaging assembly for axial engagement with an electrical connector, the electrical-connector-engaging assembly comprising: (a) a wall-surface adapter having front and back faces and attached to a wall over an opening in the wall, and (b) a backcap surrounding the plurality of wire-connection points and adjacent portions of the corresponding plurality of wires connected thereto. The wall-surface adapter back face has a plurality of wire-connection points for installation of a corresponding plurality of wires, and the wall-surface adapter front face has a plurality of slidably-engaging electrical connection points for engagement in at least an axial direction with the electrical connector. The backcap includes a twist lock for installation on the wall-surface adapter.

In some embodiments, the wall-surface adapter is attached to the wall with one or more fasteners.

In highly-preferred embodiments, the wall-surface adapter is attached to the wall through a mounting structure. In some of these embodiments, the wall-surface adapter is attached to the wall with one or more fasteners, and in some of these embodiments, the mounting structure includes a movable cover over the wall-surface adapter front face.

In highly-preferred embodiments, the wall-surface adapter has a circular outer surface defining a central axis and includes a plurality of radially-oriented projections on the outer surface, and the twist lock includes a plurality of circumferentially-aligned slots for engagement with corresponding radially-oriented projections when the backcap is turned about the central axis. In some of these embodiments, the slots have a length such that turning the backcap less than 40 degrees is required for secure engagement of the backcap to the wall-surface adapter.

In some preferred embodiments, the backcap includes an outer surface configured for non-slip gripping.

In highly-preferred embodiments, the backcap includes a slot end and an opposite distal end, the distal end having an annulus having a grip for releasably holding the plurality of wires.

In highly-preferred embodiments, the backcap is formed of polymeric material.

The term "connector" as used herein refers to any cord-end device which can be reversibly inserted into the inventive wall-mounted electrical-connector-engaging assembly. Such connector may serve as a power inlet, a power outlet, a plug or other cord-end receptacle.

DETAILED DESCRIPTION OF PREFERRED EMBODIMENTS

The figures and descriptions below describe details of the device and its preferred embodiments.

Figure 1:
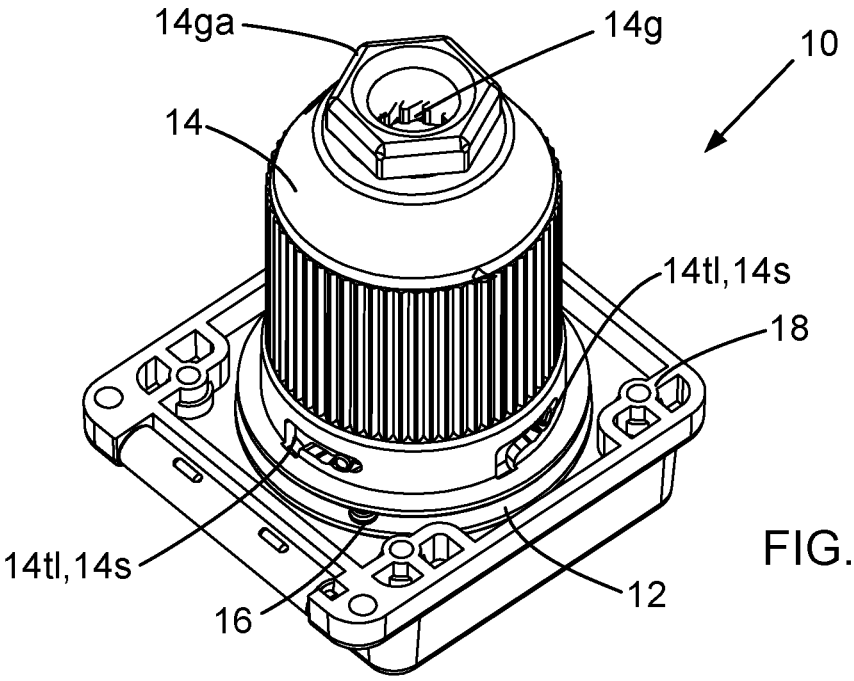
FIG. 1 is a perspective back-view illustration of an embodiment of the wall-mounted electrical-connector-engaging assembly of this invention, mounted on a mounting structure.
Figure 2:
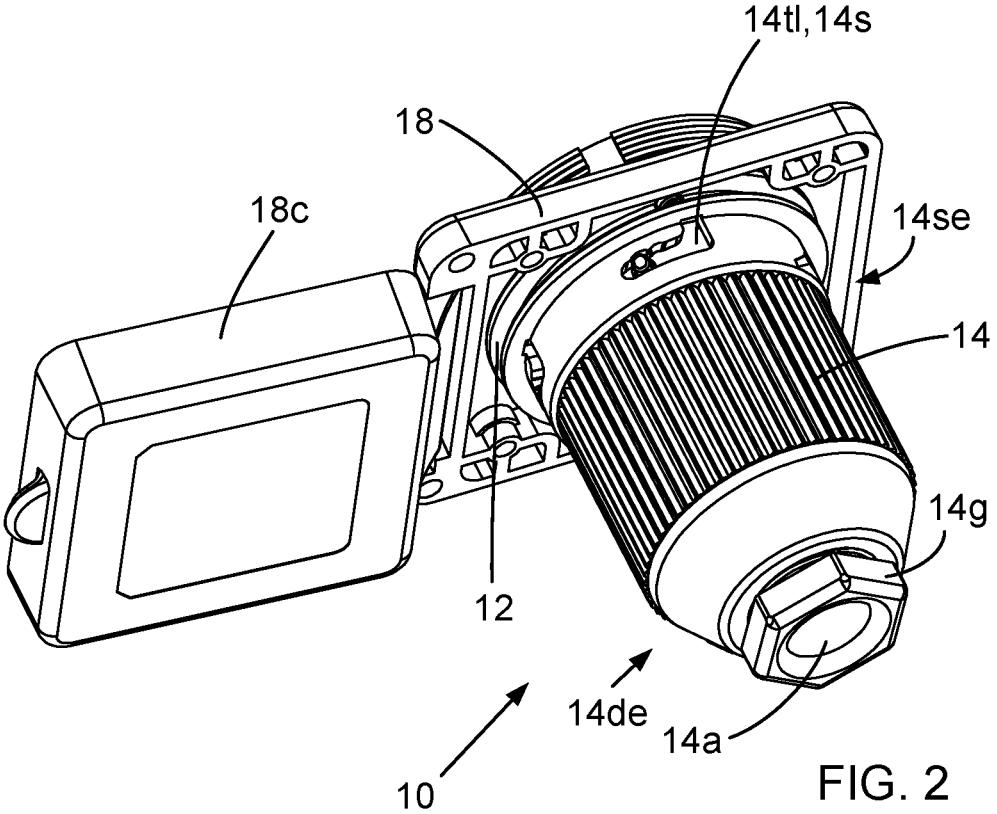
FIG. 2 is a perspective side-view illustration of the wall-mounted electrical-connector-engaging assembly embodiment of FIG. 1, mounted on a mounting structure with its cover in an open position.
Figure 3:
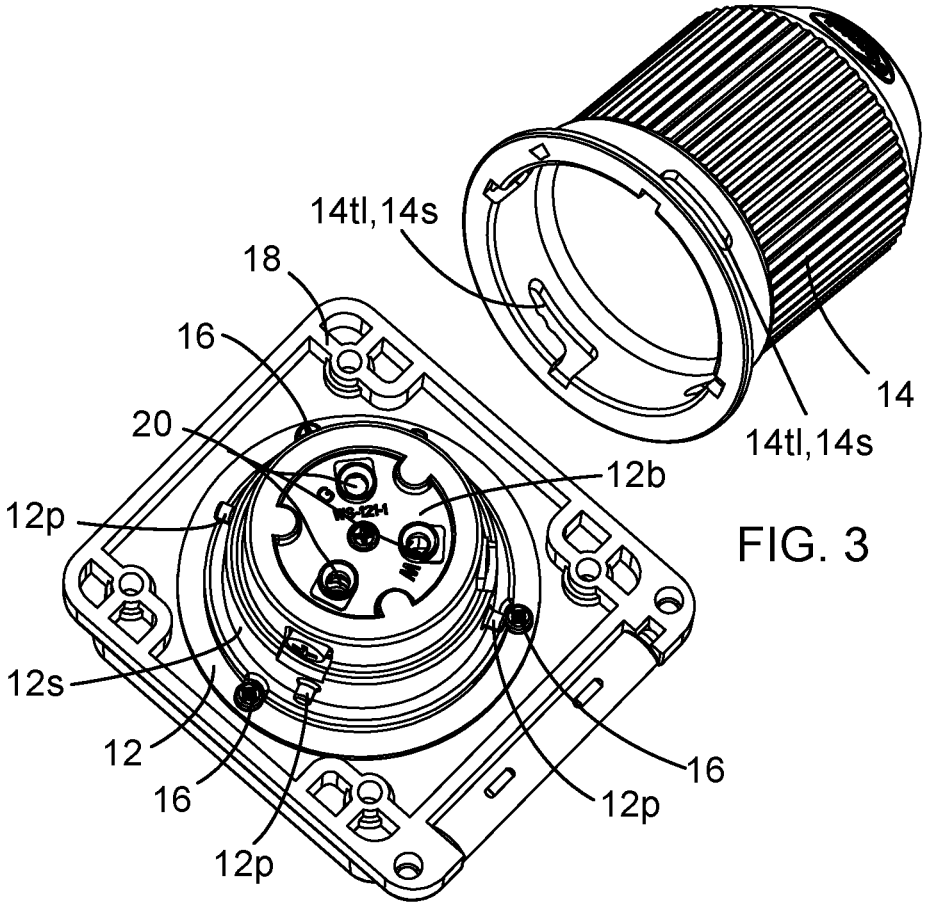
FIG. 3 is a perspective back-view illustration of the unassembled wall-mounted electrical-connector-engaging assembly embodiment of FIG. 1.
Figure 4:
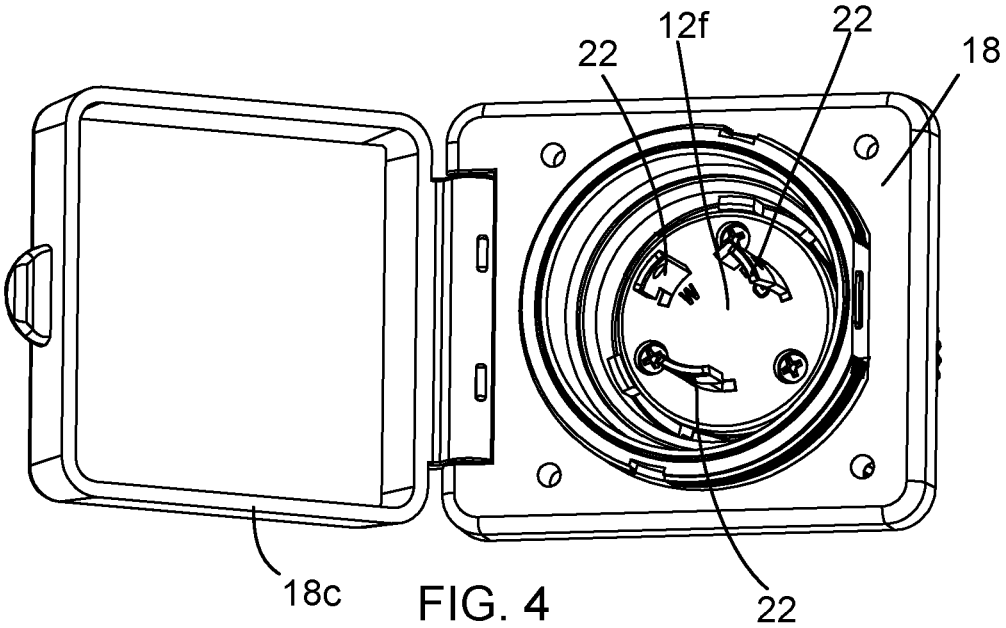
FIG. 4 is a perspective front-view illustration of the wall-mounted electrical-connector-engaging assembly embodiment of FIG. 1, mounted on a mounting structure with its cover in an open position.
Figure 7:
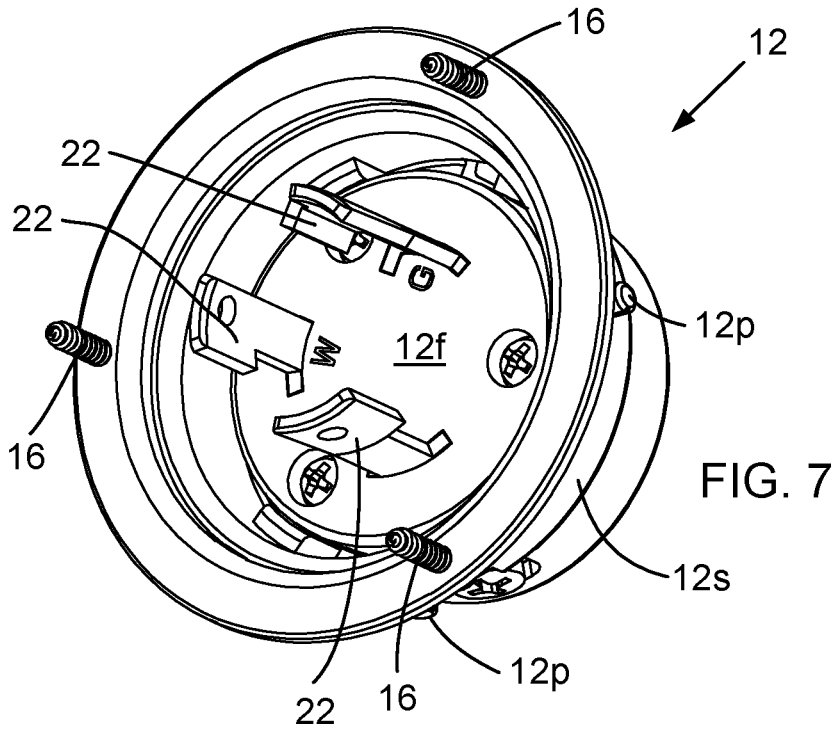
FIG. 7 is a perspective front-face-view illustration of the wall-surface adapter of the wall-mounted electrical-connector-engaging assembly embodiment of FIG. 1.
Figure 8:
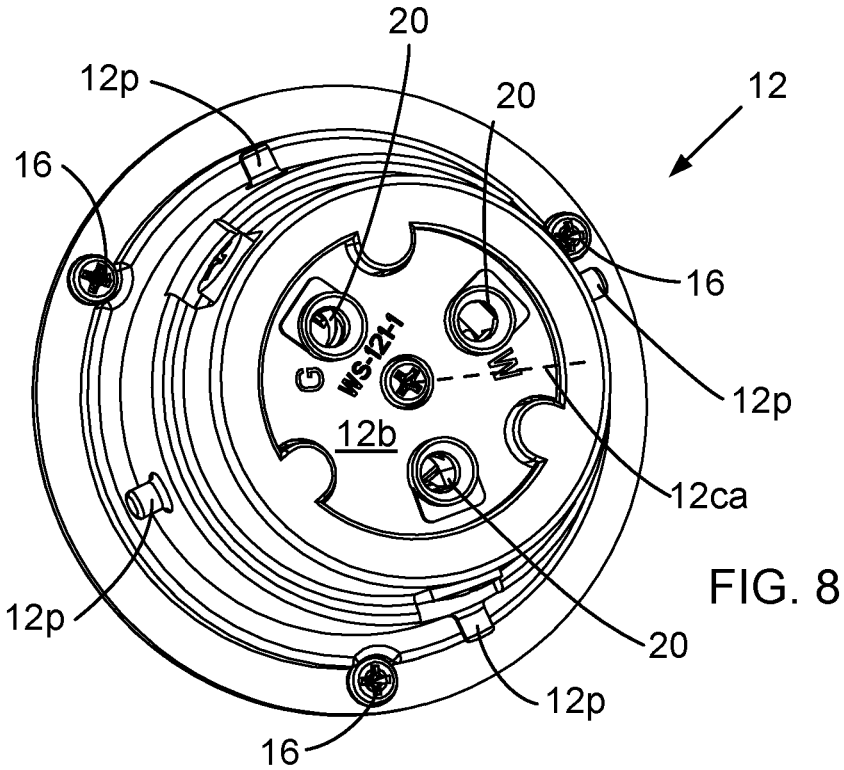
FIG. 8 is a perspective back-face-view illustration of the wall-surface adapter of the wall-mounted electrical-connector-engaging assembly embodiment of FIG. 1.

FIG. 1 is a perspective back-view drawing of an embodiment 10 of the inventive wall-mounted electrical-connector-engaging assembly (also 10), and FIG. 2 is a perspective side-view drawing of embodiment 10. In both FIGS. 1 and 2, embodiment 10 is shown mounted on a mounting structure 18; in FIG. 2, mounting structure 18 is shown with an included cover 18*c* in an open position. FIG. 3 is a perspective back-view drawing of embodiment 10, and FIG. 4 is a perspective front-view drawing of embodiment 10. FIGS. 7 and 8 show close-up views of a wall-surface adapter 12.

Referring to FIGS. 1-4, 7 and 8, embodiment 10 includes a wall-surface adapter 12 having a front face 12*f* and a back face 12*b*. Wall-surface adapter 12 is attached to a wall (not shown) over an opening (not shown) in the wall. Wall-surface adapter 12 is attached to the wall through mounting structure 18 using a plurality of fasteners 16. Wall-surface adapter 12 back face 12*b* includes a plurality of wire-connection points 20 for installation of a corresponding plurality of wires (not shown). Wall-surface adapter 12 front face 12*f* has a plurality of slidably-engaging electrical connection points 22 for engagement in at least an axial direction with the electrical connector (not shown).

Wall-surface adapter 12 also includes a circular outer surface 12*s* which defines a central axis 12*ca* (see FIG. 8), and outer surface 12*s* includes a plurality of radially-oriented projections 12*p*. (Note that the dotted line referring to central axis 12*ca* in FIG. 8 may be difficult to interpret; such dotted line is intended to be perpendicular to back face 12*b*.)

Figure 5:
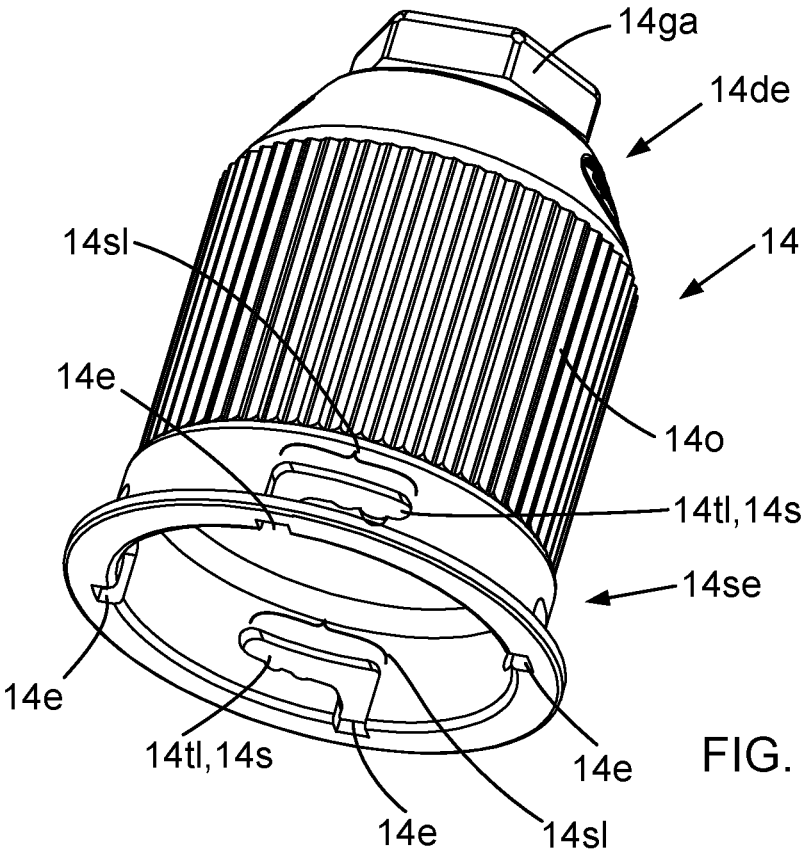
FIG. 5 is a perspective side-view illustration of the backcap of the wall-mounted electrical-connector-engaging assembly embodiment of FIG. 1.
Figure 6:
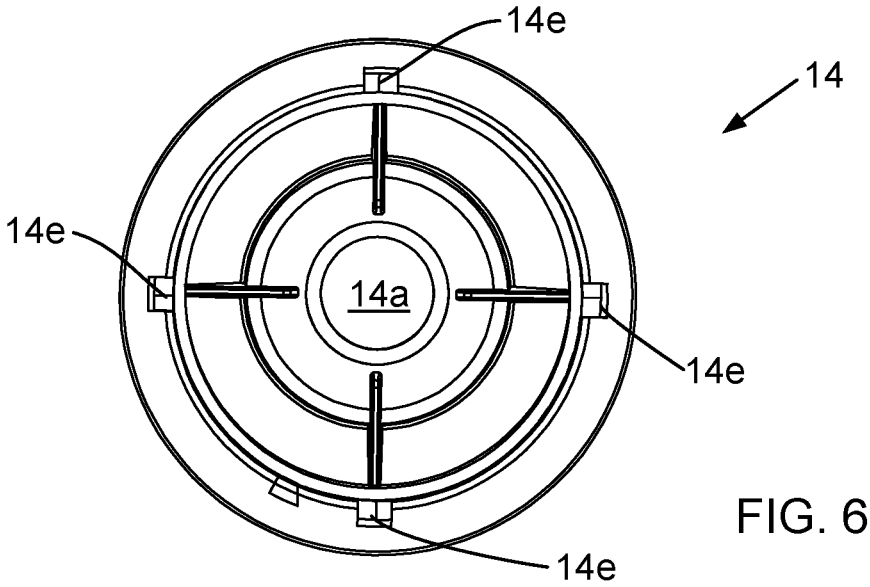
FIG. 6 is a perspective bottom-view illustration of the backcap of the wall-mounted electrical-connector-engaging assembly embodiment of FIG. 1.

Embodiment 10 also includes a backcap 14 which surrounds the plurality of wire-connection points 20 and adjacent portions of the corresponding plurality of wires (not shown) connected thereto. FIGS. 5 and 6 show a side view and bottom view, respectively, of backcap 14. Backcap 14 also includes a plurality of circumferentially-aligned slots 14*s* for engagement with corresponding radially-oriented projections 12*p* when backcap 14 is turned about central axis 12*ca*. Thus, wall-surface adapter 12 and backcap 14 are twist-locked together with a twist lock 14*t*1, securing backcap 14 to wall-surface adapter 12. Twist lock 14*t*1 includes the plurality of slots 14*s*. Slots 14*s* of backcap 14 include slot entries 14*e* into which projections 12*p* enter slots 14*s* during the twist-locking action. Slots 14*s* have a slot length 14*s*1 which may be of length such that a turn through 40 degrees or less effects the twist-locking action. Note that the number of slots 14*s* of twist lock 14*t*1 is not intended to be limiting; twist lock 14*t*1 may be configured using one or more slot 14*s* with wall-surface adapter 12 having a corresponding number of projections 12*p*.

Backcap 14 also includes a slot end 14*se* and an opposite distal end 14*de*. Distal end 14*de* includes an annulus 14*a* around which is a grip 14*g* for releasably holding the plurality of wires (not shown) which are connected to connection points 20. Backcap 14 includes a grip actuator 14*ga* which actuates grip 14*g* (see FIG. 1) around the wires. In embodiment 10, grip actuator 14*ga* is hexagonal, but such configuration is not intended to be limiting.

Backcap 14 of embodiment 10 also includes an outer surface 14*o* configured for non-slip gripping of backcap 14 during the twist-locking action. Backcap 14 may be formed of polymeric materials but many other suitable materials are available.

While the principles of this invention have been described in connection with specific embodiments, it should be understood clearly that these descriptions are made only by way of example and are not intended to limit the scope of the invention.

The invention claimed is:

1. A wall-mounted assembly for axial engagement/disengagement with an electrical connector, the wall-mounted assembly comprising:

a wall-surface adapter having front and back faces and attached to a wall over an opening in the wall, the wall-surface adapter back face exposed through the wall opening and having a plurality of wire-connection points for installation of a corresponding plurality of wires, and the wall-surface adapter front face having a plurality of slidably-engaging electrical connection points for engagement/disengagement in at least an axial direction with the electrical connector; and a backcap surrounding the plurality of wire-connection points and adjacent portions of the corresponding plurality of wires connected thereto, the backcap including a twist lock for installation over the back face of the wall-surface adapter.

2. The assembly of claim 1 wherein the wall-surface adapter is attached to the wall with one or more fasteners.

3. The assembly of claim 1 wherein the wall-surface adapter is attached to the wall through a mounting structure.

4. The assembly of claim 3 wherein the wall-surface adapter is attached to the mounting structure with one or more fasteners.

5. The assembly of claim 3 wherein the mounting structure includes a movable cover over the wall-surface adapter front face.

6. The assembly of claim 1 wherein the wall-surface adapter has a circular outer surface defining a central axis and includes a plurality of radially-oriented projections on the outer surface, and the twist lock includes a plurality of circumferentially-aligned slots for engagement with corresponding radially-oriented projections when the backcap is turned about the central axis.

7. The assembly of claim 6 wherein the slots have a length such that turning the backcap less than 40 degrees is required for secure engagement of the backcap to the wall-surface adapter.

8. The assembly of claim 1 wherein the backcap includes an outer surface configured for non-slip gripping.

9. The assembly of claim 1 wherein the backcap includes a slot end and an opposite distal end, the distal end having an annulus having a grip for releasably holding the plurality of wires.

10. The assembly of claim 1 wherein the backcap is formed of polymeric material.

* * * * *